United States Patent [19]

Siebens et al.

[11] 4,353,611

[45] Oct. 12, 1982

[54] BUSHING WELL STUD CONSTRUCTION

[75] Inventors: Larry N. Siebens, Great Meadows; Alan D. Borgstrom, Hackettstown, both of N.J.

[73] Assignee: Amerace Corporation, New York, N.Y.

[21] Appl. No.: 129,618

[22] Filed: Mar. 6, 1980

[51] Int. Cl.[3] ..... H01A 13/621

[52] U.S. Cl. ..... 339/92 R

[58] Field of Search ..... 339/92, 111, 143 R, 339/126 R, 126 RS; 179/152 R, 153 R; 411/395, 403, 270

[56] References Cited

U.S. PATENT DOCUMENTS 1,969,142 8/1939 McIntyre ..... 411/270 X
3,044,584 7/1962 Thompson ..... 411/403 X
3,622,946 11/1971 Rogers ..... 339/126 RS
4,199,213 4/1980 Tachick ..... 339/111

*Primary Examiner*—Eugene F. Desmond
*Attorney, Agent, or Firm*—Arthur Jacob; David Teschner; Richard A. Craig

[57] ABSTRACT

A bushing insert of a high voltage electrical distribution system is mechanically coupled and electrically connected to a bushing well by means of a threaded coupling member, a portion of which coupling member is threaded to the electrical contact element of the bushing well, the coupling member having a wrenching configuration enabling that portion of the coupling member to be removed from the electrical contact element of the bushing well should the portion inadvertently become severed from the remainder of the coupling member.

7 Claims, 10 Drawing Figures

BUSHING WELL STUD CONSTRUCTION

The present invention relates generally to the construction of components employed in high voltage electrical distribution systems and pertains, more specifically, to an improvement in the arrangement for coupling a bushing insert with a bushing well in a high voltage electrical distribution system.

Currently, bushing wells are constructed with an integral threaded stud which is unitary with the electrical contact element of the bushing well and serves as a threaded connector for mechanically coupling and electrically connecting a bushing insert to the bushing well. During assembly of the bushing insert with the bushing well, the threaded connection between the components sometimes is overtightened, resulting in the stud breaking from the electrical contact element. Alternately, in disassembling a bushing insert from a bushing well, the threaded connection sometimes is found to be seized and the result, once again, is a severing of the threaded stud from the electrical contact element of the bushing well. In other instances, the thread of the stud has become damaged, as by galling, thus rendering the stud useless in attaining the desired coupling and connection.

In each of the above instances the end result is a requirement for replacement of the entire bushing well, leading to considerable down-time in the electrical distribution system and considerable extra expense.

It is an object of the present invention to provide a bushing well stud construction which enables simplified removal and replacement of a damaged or broken stud without requiring replacement of the entire bushing well.

Another object of the invention is to provide an improved bushing well stud construction in which the threaded stud is removably secured to the electrical contact element of the bushing well so as to be selectively replaceable without disturbing the installed bushing well.

Still another object of the invention is to provide an improved bushing well stud construction of the type described and in which the broken stud fragment which remains engaged with the electrical contact element of the bushing well is removed easily to enable replacement of a broken stud without disturbing the installed bushing well.

Yet another object of the invention is to provide an improved bushing well stud construction of the type described and in which the stud is locked against unwanted removal from the electrical contact element of the bushing well.

A further object of the invention is to provide an improved bushing well stud construction of the type described and which is compatible with bushing inserts now in use in the field so as to enable immediate, widespread use of the improvement as a direct replacement for currently available bushing wells.

A still further object of the invention is to provide an improved bushing well stud construction of the type described and which is relatively simple in design and construction, enabling the improvement to be manufactured economically in large numbers of uniform high quality.

The above objects, as well as still further objects and advantages, are attained by the present invention, which may be described briefly as an improvement in a coupling arrangement for connecting a high voltage bushing insert with a complementary bushing well in a high voltage electrical power distribution system, the bushing insert having an insert end portion including a first electrical contact element of conductive material, and the bushing well having a receptacle for receiving the insert end portion of the bushing insert, and a second electrical contact element of conductive material integral with the bushing well, the improvement comprising: threaded fastening means in the second electrical contact element; a coupling member of conductive material, the coupling member having a first portion and a second portion, means for affixing the first portion of the coupling member to the first electrical contact element, and complementary threaded fastening means for engaging the threaded fastening means of the second electrical contact element to mechanically couple the bushing insert with the bushing well and electrically connect the first and second electrical contact elements; and wrenching means integral with at least the second portion of the coupling member for enabling wrenching of the second portion independent of the presence of the first portion of the coupling member, whereby, upon inadvertent severing of the first and second portions from one another, the complementary threaded fastening means of the second portion is selectively disengageable from the threaded fastening means of the second electrical contact element.

The invention will be understood more fully, while still further objects and advantages will become apparent, in the following detailed description of preferred embodiments of the invention illustrated in the accompanying drawing, in which.

Figure 1:
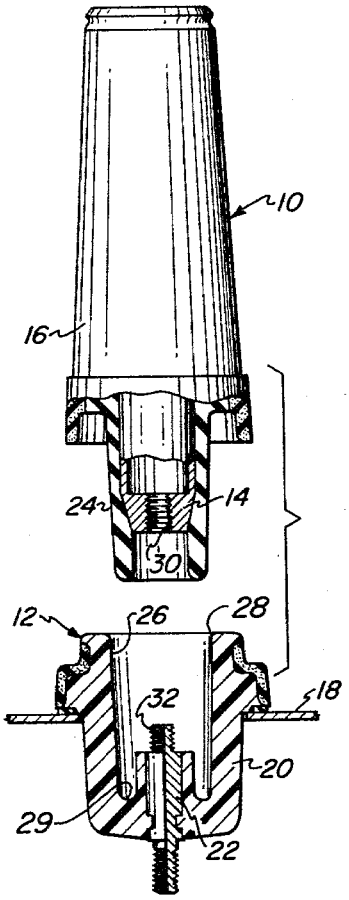
FIG. 1 PRIOR ART
FIG. 1 is a partially sectioned elevational view of a typical bushing insert and bushing well about to be assembled.

Referring now to the drawing, and especially to FIG. 1 thereof, a connection is about to be made between a bushing insert 10 and a bushing well 12 in a typical high voltage electrical distribution system. Bushing insert 10 has a well-known construction which includes an electrical contact element 14 within a housing 16 constructed primarily of dielectric material. Bushing well 12 is more-or-less permanently installed in an electrical device, such as a power transformer 18, and includes a well member 20 constructed of dielectric material and an integral electrical contact element 22 permanently secured within the well member, as by molding the well member 20 integrally around the electrical contact element 22, in a manner now well-known in the art of electrical connector construction.

Figure 2:
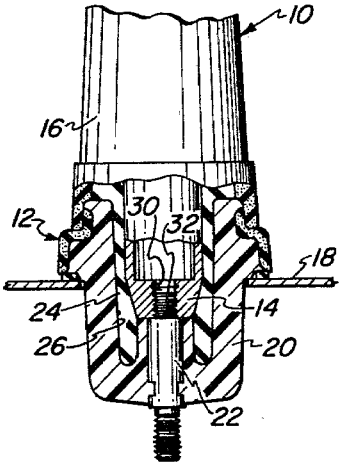
FIG. 2 PRIOR ART
FIG. 2 is a fragmentary view of the bushing insert and bushing well of FIG. 1 in assembled relationship.

Bushing insert 10 has an insert end portion 24 which is an extension of housing 16, while bushing well member 20 includes a receptacle 26 extends between an opening 28 and a remote closed bottom 29 spaced from the opening 28 within bushing well member 20. Electrical contact element 14 includes a threaded aperture 30, while electrical contact element 22 includes an externally threaded stud 32 unitary therewith and projecting into the receptacle 26. Insert end portion 24 is complementary with receptacle 26, and threaded stud 32 is complementary with threaded aperture 30 so that the bushing insert 10 is assembled with bushing well 12 by engaging insert end portion 24 with receptacle 26 and engaging threaded stud 32 with threaded aperture 30, as seen in FIG. 2. Once the assembly is complete, an electrical connection is effected between the electrical contact elements 14 and 22, and the bushing insert 10 is coupled mechanically to the bushing well, by the threaded connection between the threaded stud 32 and the threaded aperture 30. The connection is appropriately insulated by the engagement of insert end portion 24 with receptacle 26.

Figure 3:
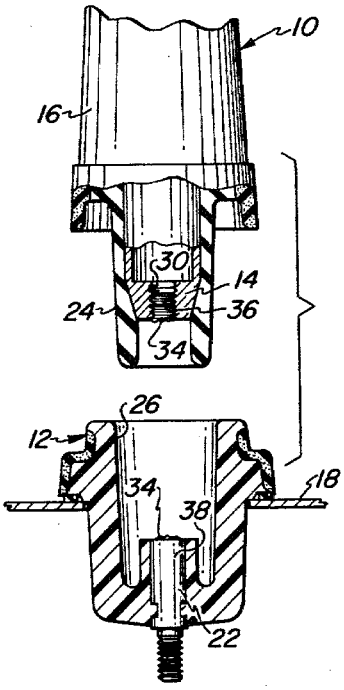
FIG. 3 PRIOR ART
FIG. 3 is a fragmentary view of the components shown in FIGS. 1 and 2 illustrating a typical mode of failure.

During assembly, as described above, the bushing insert sometimes is overtightened, resulting in the stud breaking. As seen in FIG. 3, overtightening of bushing insert 10 can break the stud 32 at 34, thereby breaking the mechanical coupling between the bushing insert 10 and the bushing well 12. The components will then separate, with a severed fragment 36 remaining within the electrical contact element 14 and the remainder 38 of the electrical contact element 22 remaining in the bushing well 12. Similar fracturing of the electrical contact element 22 has been experienced in attempting to disassemble a bushing insert from a bushing well when the threaded connection between the stud and the threaded aperture is seized. Such fractures render the bushing well no longer serviceable as a means for connecting a bushing insert. Likewise, the vulnerability of the projecting stud 32 can lead to damage of the thread of the stud, as by galling, or bending of the stud, or other damage short of fracture, any of which conditions can render the bushing well useless. In such instances, it has been the practice to shut down the electrical distribution system and then remove and replace the entire bushing well 12.

Figure 4:
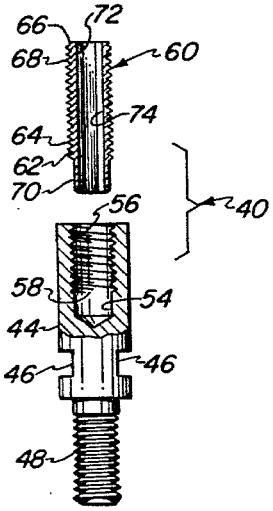
FIG. 4 is an exploded, partially sectioned elevational view of a bushing well stud contructed in accordance with the invention.
Figure 5:
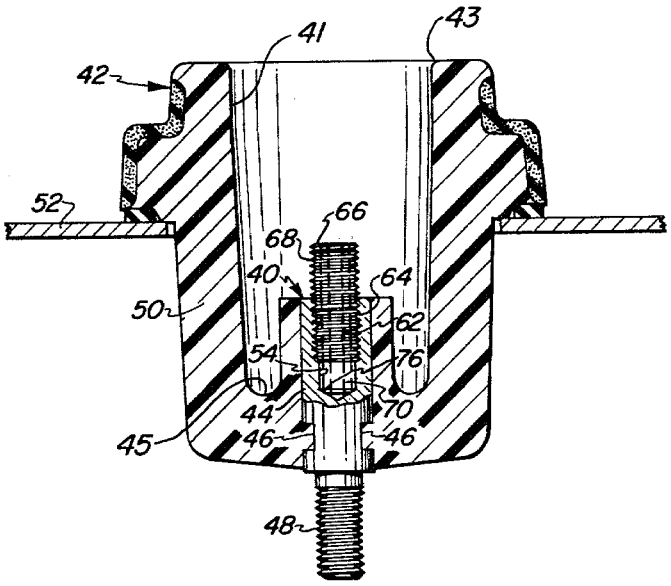
FIG. 5 is an enlarged, longitudinal cross-sectional view of the bushing well stud of FIG. 4 assembled and installed in a bushing well.
Figure 6:
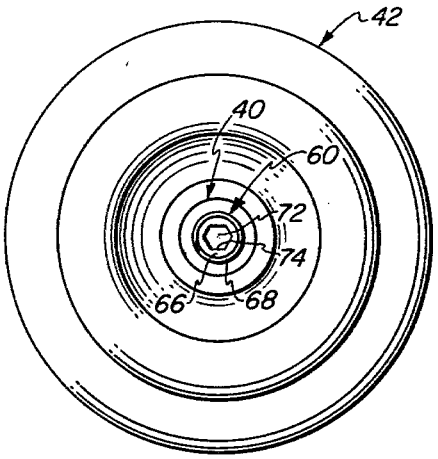
FIG. 6 is a top plan view of the installed bushing well stud of FIG. 5.

In order to alleviate the problem of replacing the entire bushing well when the threaded stud fails, as outlined above, the present invention provides an improvement in the form of an electrical contact element 40, illustrated in FIGS. 4 through 6, which serves as the electrical contact element of a bushing well 42, as seen in FIGS. 5 and 6. Bushing well 42 includes a receptacle 41 extending between an opening 43 and a remote closed bottom 45 spaced from the opening 43. Electrical contact element 40 includes a cylindrical member 44 of conductive material having diametrically opposed recesses 46 and a unitary projecting threaded post 48. The cylindrical member 44 is permanently embedded within the molded dielectric material of bushing well member 50 of bushing well 42 so as to be integral therewith. The material of bushing well member 50 enters the recesses 46 to assure that cylindrical member 44 is captured within the bushing well member and is secured against rotation, as well as against axial movement, relative thereto. Threaded post 48 is provided at one end of cylindrical member 44 for electrical connection to the electrical device 52 upon which the bushing well 42 is mounted.

A hole 54 is provided at the other end of cylindrical member 44 and an internal thread 56 extends into the hole 54 and terminates at 58, short of the bottom end of the hole 54. In order to enable a bushing insert, such as bushing insert 10, to be coupled mechanically to bushing well 42 and electrically connected to electrical contact element 40, a coupling member of conductive material is provided and is shown in the form of threaded rod 60. Threaded rod 60 includes a first portion in the form of shank 62 of rod 60, shank 62 having an external thread 64 complementary to the internal thread 56 of hole 54. A second portion of threaded rod 60 is shown in the form of pin 66 having an external thread 68 complementary to the internal thread of threaded aperture 30 of the electrical contact element 14 of bushing insert 10. Preferably, external thread 64 and external thread 68 together constitute a single thread extending along both portions of the threaded rod 60. Shank 62 includes an unthreaded extension 70 for purposes which will be set forth in detail below.

Threaded rod 60 is provided with wrenching means shown in the form of an internal passage 72 extending through the entire length of threaded rod 60. A wrenching configuration is provided, in this instance, by a hexagonal internal cross-sectional configuration providing a wrenching socket 74 in the internal passage 72. Preferably, the hexagonal wrenching socket 74 extends along the entire length of threaded rod 60.

Upon the insertion of shank 62 into hole 54 and seating of the rod 60 appropriately within the cylindrical member 44, unthreaded extension 70 is jammed against portion 76 of hole 54 to serve as a locking means tending to lock the rod 60 against rotation within cylindrical member 44 once installation of the rod is complete. Such a locking action establishes a locking force which increases the breakloose torque required to remove the rod 60 from the cylindrical member 44 so that the rod 60 will remain with the bushing well 42 upon disassembly of the bushing insert 10 from the bushing well 42.

Assembly of the bushing insert 10 with the bushing well 42 is accomplished in the conventional manner, with threaded pin 66 engaging the threaded aperture 30 of the electrical contact element 14 of bushing insert 10 to complete the mechanical coupling and electrical connection between the bushing insert 10 and the bushing well 42. Disassembly of the bushing insert 10 from the bushing well 42, again, is accomplished in the conventional manner merely by unthreading the connection between pin 66 and aperture 30.

Figure 7:
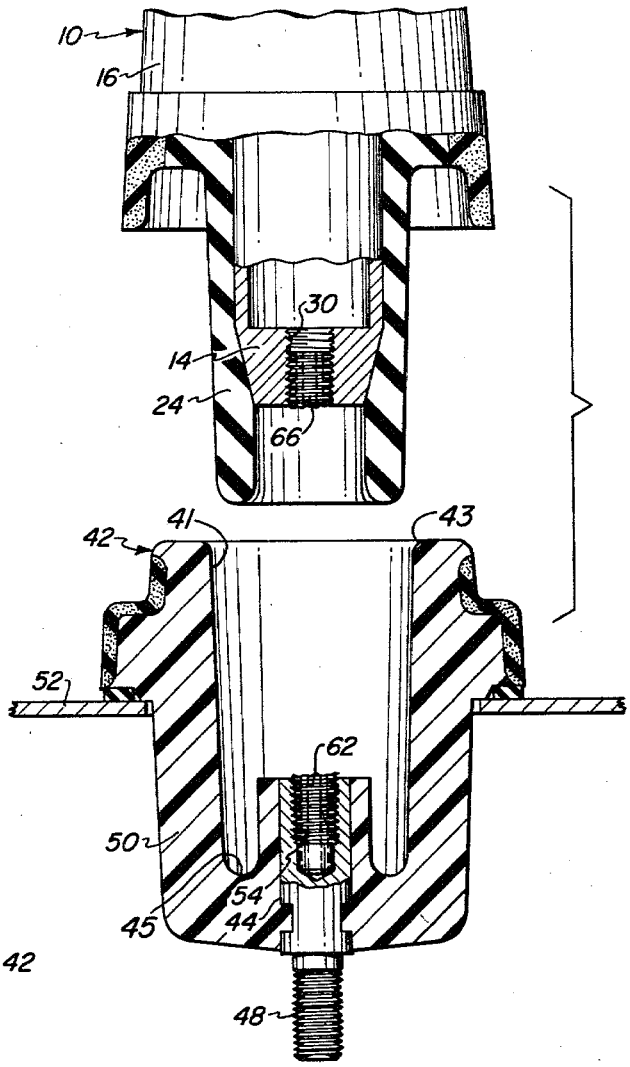
FIG. 7 is a fragmentary view similar to FIG. 3, but incorporating the bushing well stud of FIGS. 4 through 6.

Should the rod 60 break, as shown in FIG. 7, either by overtightening or seizure of the threads as outlined above, the threaded pin 66 will remain in aperture 30 as a severed fragment of the electrical contact element 40, while the shank 62 will remain in hole 54 with the remainder of the electrical contact element 40. Repair is accomplished easily and quickly merely by inserting an appropriate wrench (not shown) into the wrenching socket 74 within the shank 62 and removing the shank 62 from the cylindrical member 44. A new rod 60 is then installed within cylindrical member 44 to return bushing well 42 to a useable state. By extending wrenching socket 74 into the pin 66, the severed fragment lodged within aperture 30 of the bushing insert likewise is removed easily by the use of the same wrench. Thus, the assembly between the bushing insert 10 and the bushing well 42 is restored quickly and easily, and without requiring the installation of an entire replacement bushing well. Should pin 66 become damaged, though not severed from shank 62, the entire rod 60 is removed readily and easily replaced so as to restore bushing well 42 to service.

Figure 10:
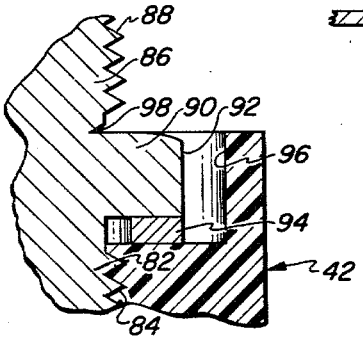
FIG. 10 is an enlarged fragmentary sectioned view of a portion of FIG. 8.
Figure 8:
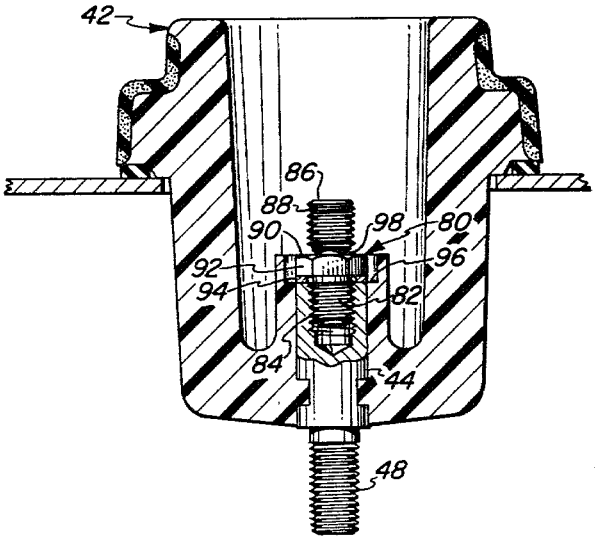
FIG. 8 is a longitudinal sectional view of an alternate bushing well stud constructed in accordance with the invention and installed in a bushing well.
Figure 9:
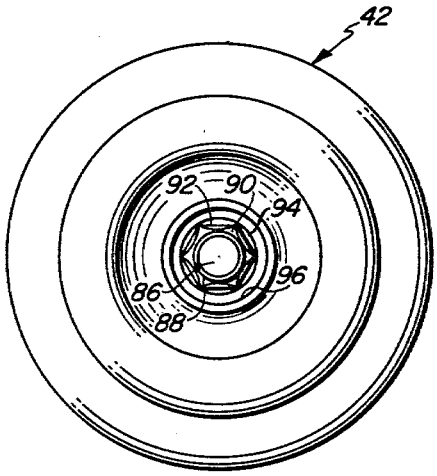
FIG. 9 is a top plan view of the installed bushing well stud of FIG. 8.

Turning now to FIGS. 8, 9 and 10, another embodiment of the present invention is illustrated in the form of an alternate coupling member 80 seated within the cylindrical member 44 of electrical contact element 40 of bushing well 42. Coupling member 80 includes a first portion in the form of a shank 82 having an external thread 84 complementary to internal thread 56 of hole 54. A second portion of coupling member 80 is shown in the form of pin 86 having an external thread 88 complementary to the internal thread of threaded aperture 30 of the electrical contact element 14 of bushing insert 10.

Wrenching means is provided by a collar 90 located between the shank 82 and the pin 86 and having a hexagonal wrenching configuration 92. A lockwasher 94 serves as locking means to increase the breakloose torque so that coupling member 80 will remain engaged with cylindrical member 44 upon disassembly of the bushing insert 10 from bushing well 42.

Should pin 86 be severed from the remainder of coupling member 80 by excessive torque applied to the pin 86, as described above, the shank 82 may be removed readily from cylindrical member 44 by applying an appropriate wrench (not shown) to the wrenching configuration 92 of collar 90. A suitable recess 96 provides access to the wrenching configuration 92 to allow coupling of the collar 90 with the appropriate wrench. A new coupling member 80 then can be installed to restore the bushing well 42 to service.

An annular notch 98 is located between the collar 90 and the pin 86 and serves as a shear-locating means to assure that excessive torque applied to pin 86 will tend to shear the pin 86 from the remainder of the coupling member 80, thereby leaving the collar 90, and the wrenching configuration 92 thereof, integral with the shank 82. In this manner, wrenching configuration 92 will be available for removal of shank 82 from cylindrical member 44.

It is to be understood that the above detailed description of embodiments of the invention is provided by way of example only. Various details of design and construction may be modified without departing from the true spirit and scope of the invention as set forth in the appended claims.

We claim:

1. A bushing well for use in connection with a bushing insert in a high voltage electrical distribution system, the bushing insert having an insert end portion including a first electrical contact element of conductive material, the first electrical contact element including an aperture therein and an internal thread in the aperture, said bushing well comprising:

a bushing well member of dielectric material;

a receptacle in the bushing well member, the receptacle extending between an opening, for receiving the insert end portion of the bushing insert, and a remote closed bottom spaced from the opening;

a second electrical contact element of conductive material integral with the bushing well member at the closed bottom of the receptacle, the second electrical contact element having a threaded fastening means therein including a hole in the second electrical contact element and an internal thread in the hole;

a coupling member of conductive material, the coupling member having a first portion and a second portion, threaded means for affixing the first portion of the coupling member to the first electrical contact element, said threaded means including a generally cylindrical pin having an external thread complementary to the internal thread in the aperture of the first electrical contact element, and complementary threaded fastening means for engaging the threaded fastening means of the second electrical contact element to mechanically couple the bushing insert with the bushing well and electrically connect the first and second electrical contact elements, the complementary threaded fastening means including a generally cylindrical shank having an external thread complementary to the internal thread in the hole of the second electrical contact;

locking means establishing a locking force between the coupling member and the second electrical contact element for tending to lock the coupling member against rotation relative to the second electrical contact element upon engagement of the external thread of the shank with the internal thread of the hole and seating of the second portion of the coupling means within the second electrical contact element; and wrenching means integral with the second portion of the coupling means for enabling wrenching of the second portion against the locking force to allow selective removal of the second portion from the complementary threaded fastening means independent of the presence of the first portion of the coupling means.

2. The invention of claim 1 wherein the locking means includes an axial unthreaded extension of the generally cylindrical shank and a complementary axial unthreaded extension of the hole in the second electrical contact, the complementary unthreaded extensions engaging one another in locking engagement upon seating of the second portion of the coupling member within the second electrical contact element.

3. The invention of claim 2 wherein the wrenching means includes an internal passage extending axially along the first and second portions of the coupling member, and an internal wrenching configuration in the passage at least along the second portion of the coupling member.

4. The invention of claim 3 wherein the wrenching configuration extends into the first portion of the coupling member.

5. The invention of claim 1 wherein the wrenching means includes an external collar between the first and second portions of the coupling member, and an external wrenching configuration on the collar.

6. The invention of claim 5 wherein the locking means includes radially extending surfaces on the second electrical contact element and on the external collar, for confronting one another upon engagement of the coupling member with the second electrical contact element, and a locking device between the confronting radially extending surfaces for tending to lock the surfaces against relative movement upon seating of the second portion of the coupling member within the second electrical contact element.

7. The invention of claim 6 wherein the locking device includes a lock washer.

* * * * *